United States Patent [19]

Bressler

[11] 4,226,276

[45] Oct. 7, 1980

[54] DEVICE FOR PLEATING DRAPERIES

[76] Inventor: Terry L. Bressler, 255 W. 35th St., New York, N.Y. 10001

[21] Appl. No.: 950,737

[22] Filed: Oct. 12, 1978

[51] Int. Cl.[2] ..... A47H 1/00

[52] U.S. Cl. ..... 160/348

[58] Field of Search ..... 160/348

[56] References Cited

U.S. PATENT DOCUMENTS

| | | | |
|---|---|---|---|
| 2,595,549 | 5/1952 | Sherman | 160/348 |
| 2,609,873 | 9/1952 | Falkenberg | 160/348 |
| 2,623,582 | 12/1952 | Handley | 160/348 |
| 3,132,686 | 5/1964 | Jodavits | 160/348 |
| 3,198,244 | 8/1965 | Mairson | 160/348 |
| 3,441,077 | 4/1969 | Romano | 160/348 |

*Primary Examiner*—Peter M. Caun

*Attorney, Agent, or Firm*—Howard I. Schuldenfrei

[57] ABSTRACT

In a device for forming pleats in a drapery or the like of the type comprising a strip of relatively stiff material backing, for instance buckram, in the form of a band formed with transverse parallel equally spaced score lines along which the stiff material backing may be folded for the purpose of forming pleats in a flexible fabric to which it is engaged, the improvements comprising the stiff material backing with a pair of longitudinal parallel equally spaced printed score lines correspondingly parallel to the longitudinal edges of the stiff material backing along which the stiff material backing may be sewn into the fabric to be pleated, providing the stiff material backing with indicia identifying to the operator the manner in which the pleat is to be formed in the fabric, pre-marking the stiff material backing with a transferable means for pre-measuring and stitching each group of pleats formed in the fabric and providing the stiff material backing with aligned transferable markings at which the formed pleat may be tacked for finishing the pleat.

2 Claims, 3 Drawing Figures

FIG. 1
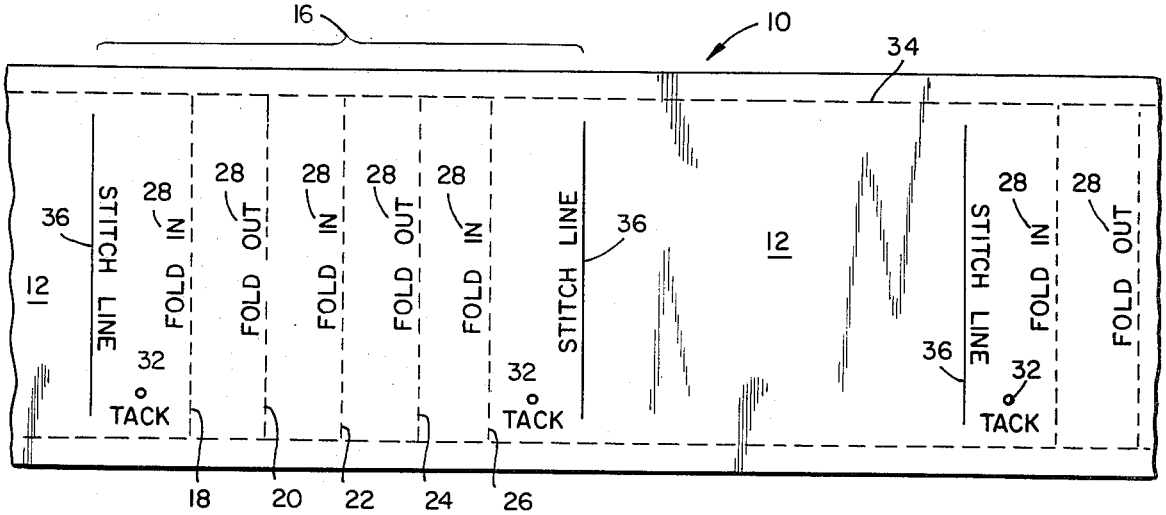
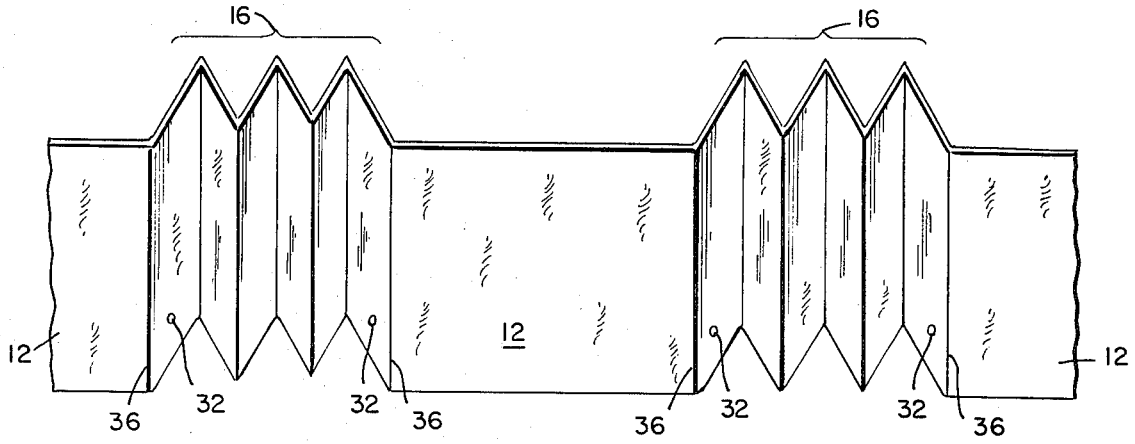
FIG. 2
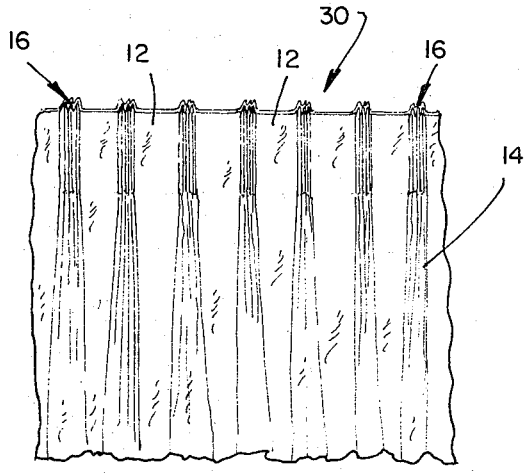
FIG. 3

DEVICE FOR PLEATING DRAPERIES

BACKGROUND OF THE INVENTION

This invention relates to an improved device for facilitating the forming of pleats in a fabric article, such as a drape.

In the past, the pleating of curtains and drapes has required considerable time and the operator has experienced considerable difficulty in forming pleats of the same size and spacing to achieve the balance of symmetry desired in the finished pleat. The time and difficulties become more severe where it is required to provide a group of pleats at spaced intervals on the fabric.

To obviate the difficulties set forth above, it has been suggested that a stiff material backing be provided in the form of a band having transverse parallel and equally spaced scored or perforated lines which are adapted to indicate fold lines at which the strip is to be bent or folded to form the required pleats. Such strip of material backing is to be attached to the inside surface of the fabric to be pleated along an undefined stitch line whereby both the fabric and backing are to be simultaneously folded along the fold lines to form the pleats which are required to be sewn along stitch lines estimated and formed by the operator to provide the finished pleats. While this suggestion successfully solved many of the problems in the prior conventional methods of making pleats, it is the principal object of the present invention to improve the features of advantage realizeable by the use of that device to the extent of overcoming, if not eliminating, certain disadvantages of the prior device.

This prior device has relied upon the skill of the operator to initially stitch the backing to the fabric to be pleated to permanently fasten the backing on the fabric along the most desireable longitudinal line and relies upon eye measurement by the operator for the purpose of gauging the stitch line forming the plait. The improved device of the instant invention overcomes these disadvantages of the former device and contributes improvements thereto which enhance its operability. For instance, according to the instant invention, the buckram is pre-scored and marked whereby merely folding and bending the buckram along predetermined lines, a professional-looking plait may be facilely formed by an inexperienced operator.

SUMMARY OF THE INVENTION

Generally speaking, in accordance with the invention, a strip of backing, for instance a relatively stiff material such as buckram, in the form of a band is provided. The backing is formed with plural groupings of transverse parallel equally spaced printed score lines along which the backing may be folded for the purpose of forming pleats in a flexible fabric to which it is stitchingly engaged. Each group of transverse score lines is defined by a concomitant pair of transverse parallel stitch lines at pre-determined distances from each other, which are suited to overlie each other as the group of transverse fold lines are folded to form a plait, and further suited to form an aligned stitch line for permanently forming the plait.

A pair of longitudinal parallel equally spaced printed score lines are formed in the backing and are correspondingly parallel to the longitudinal edges thereof. The backing may be sewn into the fabric to be pleated along these longitudinally extending score lines. Transferable aligned markings are medianly provided on the backing at which the formed pleat may be tacked and thereby finished.

Indicia is carried on the backing indicating the manner in which the backing and fabric is to be overlapped along each grouping of transverse fold lines for the purpose of forming a plait in the fabric. The plait is formed when the transverse stitch lines defining the group of fold lines overlap in aligned relationship.

Accordingly, it is an object of this invention to provide an improved device for forming pleats in a fabric article, such as a curtain or drape.

Another object of the invention is to provide a pleating backing which permits the operator to form identically symmetrical groups of plaits each and every time.

A further object of the invention is to provide a pleating backing having pre-measured means for mounting and fastening in the fabric to be pleated.

Still another object of the invention is to provide a pleating backing carrying indicia for the operator, whereby an untutored operator may form a perfect plait.

Still other objects and advantages of the invention will in part be obvious and will in part be apparent from the Specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a plan view of the preferred embodiment of the invention;

FIG. 2 is a perspective view of the embodiment shown in FIG. 1, bent at the fold lines; and FIG. 3 is a perspective view showing a plurality of finished plaits formed on a portion of the upper end of a fabric curtain including the attached embodiment as seen in FIGS. 1 and 2.

DETAILED DESCRIPTION OF THE INVENTION

Referring now to the Figs., the improved device is generally indicated by numeral 10. In FIG. 1, the device 10 is shown in its commercially available form, a strip of relatively stiff material backing 12, for instance buckram, which is shape-retaining and suited to reinforce a fabric hanging, such as curtain or drape 14, as best seen in FIG. 3. Backing 12 includes foldable groupings 16 in which a group of pleats, which are to be simulated in fabric hanging 14, may be formed. Each foldable grouping 16 includes five (5) transverse parallel equally spaced score lines, respectively 18, 20, 22, 24 and 26, along which the backing 12 may be folded alternately inwardly and outwardly relative to the plane of backing 12 for the purpose of forming the pleats. Contiguous to each of the score lines 18, 20, 22, 24 and 26 is printed indicia 28 which instructs the operator to alternately fold inwardly or outwardly along each respective score line for the purpose of forming the pleat grouping.

As best seen in FIG. 2, the backing 12 is partially formed into a simulated pleat by folding along respective score lines 18–26, according to indicia 28. Since backing 12 is shape-retaining, the pleat grouping 16 shall retain its form after folding. The backing 12 may be drawn from a continuous roll and cut to a length suited to the length of the fabric hanging.

The finished drapery or curtain 30 having the backing 12 mounted therein is best seen in FIG. 3. The pleats seen in drapery or curtain 30 are in finished form, when all the pleats 16 are stitchingly secured therein. The pleated drapery or curtain 30 is shown in the extended essentially flat position in which such items are customarily hung on rods or the like.

In practice, a strip of backing 12 substantially commensurate in length with the upper longitudinal edge of the fabric hanging 14 is cut from the continuous roll. The backing 12 is laid along the reverse side of the fabric hanging adjacent to the upper longitudinal finished edge thereof. Having suitably aligned backing 12 on the fabric hanging 14, the backing 12 and fabric hanging 14 may then be securely fastened together by sewing backing 12 to fabric hanging 14 along printed stitch line 34. As is apparent from the description, the backing 12 should be overlayed on the fabric hanging 14 so that the indicia markings and scoring face the operator.

The operator may then grasp the reinforced fabric between his fingers and correspondingly fold fabric hanging 14 and pleat grouping 16 inwardly and outwardly along score lines 18–26 according to indicia 28. Because of its shape-retaining character, backing 12 retains the folds made therein, concomitantly deforming annexed fabric hanging 14. The group of pleats formed respectively in fabric hanging 14 and backing 12 is drawn formly together until the respective stitch lines 36 defining each grouping 16 are in aligned overlying relationship. Using conventional techniques, stitch lines 36 and tack marks 32 are transferred to the outside of the pleat. The backing 12 and fabric hanging 14 are then sewn along overlying stitch lines 36 to complete the pleat grouping in fabric hanging 14 as seen at numeral 30 and tacked at transferred markings 32 to finish the pleat.

When the finished drapery or curtain is hung on a window or other desired place, the pleats formed therein shall retain their shape and appearance whether the drape or curtain is drawn or in open position. When the drape or curtain is in a drawn position, it shall retain its orderly decorative appearance since the backing 12 is sufficiently resiliently deformable to accommodate the stress it is subjected to, without becoming permanently deformed. Each of the groupings 16 are premeasured on backing 12 and each such grouping 16 is equidistant from the next proximate grouping 16. Therefore, an extremely symmetrical and orderly decorative arrangement is created.

By following the sequence set forth above, plural equidistant pleat groupings may be formed in the longitudinal margin of the drapery or curtain. To minimize spreading between individual pleats in each grouping, the operator may tack the pleats amongst each individual grouping 16. The provision of the indicia and preprinted scoring of the crease and stitch lines on the backing 12 remove guesswork from the procedure and reduce the level of skill of the operator required to complete the procedure. The fabric hanging is immediately responsive to the folding provided in the relatively stiff backing 12 for the purpose of forming the pleat grouping.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention herein described, and all statements of the scope of the invention which, as a matter of language, might be said to fall therebetween.

What is claimed is:

1. An improved backing for forming symmetrical groupings of pleats in a drapery or the like comprising a thin strip of resilient permanently deformable material which may be pre-measured to a desired length and mounted in said drapery or the like including a plurality of transverse pleat groupings provided therein, each pleat grouping comprising a discrete plurality of parallel transverse equidistant printed score lines, each such discrete plurality of said score lines being transversely bounded by a corresponding pair of printed stitch lines, said material being permanently deformable by folding along said discrete pluralities of said score lines and otherwise being impermanently resiliently deformable along its length, each of said respective pairs of transverse stitch lines being alignable in overlapping relationship when said material is folded along a discrete plurality of said transverse score lines; a pair of parallel longitudinal stitch lines, each of said stitch lines being equidistant from a respective longitudinal edge of said material; a plurality of aligned paired markings on said material, each of said paired markings corresponding to a discrete plurality of said score lines; and printed indicia adjacent each of said score lines aiding an operator in forming a pleat in each discrete plurality of said score lines.

2. The improved backing as claimed in claim 1, wherein said resiliently deformable material is buckram.

* * * * *